US010640977B2

(12) United States Patent
Kim

(10) Patent No.: US 10,640,977 B2
(45) Date of Patent: May 5, 2020

(54) CONCRETE STRUCTURE USING REINFORCING PANEL INCLUDING EMBEDDED REINFORCING GRID AND METHOD OF REPAIRING AND REINFORCING THE SAME

(71) Applicant: KOREA INSTITUTE OF CIVIL ENGINEERING AND BUILDING TECHNOLOGY, Gyeonggi-do (KR)

(72) Inventor: Hyeong Yeol Kim, Gyeonggi-do (KR)

(73) Assignee: KOREA INSTITUTE OF CIVIL ENGINEERING AND BUILDING TECHNOLOGY, Gyeonggi-do (KR)

( * ) Notice: Subject to any disclaimer, the term of this patent is extended or adjusted under 35 U.S.C. 154(b) by 0 days.

(21) Appl. No.: 15/849,673

(22) Filed: Dec. 21, 2017

(65) Prior Publication Data

US 2019/0153728 A1 May 23, 2019

(30) Foreign Application Priority Data

Nov. 21, 2017 (KR) ..... 10-2017-0155353

(51) Int. Cl.
*E04G 23/02* (2006.01)
*E04C 2/06* (2006.01)
(Continued)

(52) U.S. Cl.
CPC ..... *E04C 2/06* (2013.01); *E04C 2/526* (2013.01); *E04C 5/0627* (2013.01); *E04C 5/07* (2013.01);
(Continued)

(58) Field of Classification Search
CPC ..... E04G 23/0218; E04G 23/0211; E04G 23/0222; E04G 23/0229; E04G 23/0203; E01C 7/147
See application file for complete search history.

(56) References Cited

U.S. PATENT DOCUMENTS 1,558,783 A * 10/1925 Bleecker ..... E01C 7/147 427/136
5,185,013 A * 2/1993 Martin ..... E01C 11/005 156/94
(Continued)

FOREIGN PATENT DOCUMENTS

JP H04348331 12/1992
JP 2012062628 3/2012
(Continued)

*Primary Examiner* — Gisele D Ford
(74) *Attorney, Agent, or Firm* — JCIPRNET

(57) ABSTRACT

Reinforcing panel having high durability, high strength, and high hardness is applied such that a concrete structure may be repaired to have excellent resistance to an external environment and to be structurally excellent. In comparison to existing bonding methods, a concrete structure and a reinforcing panel may be completely attached to each other as a whole using a repairing material with high fluidity as a cement-based material injected into a repair cross section. Part with microcracks is completely filled with repairing cement mortar injected at high pressure. Since reinforcing panel is precast-fabricated in a factory, embossing, intaglio, color, and the like may be easily added to an external surface of the reinforcing panel and an excellent exterior may be provided after repair due to an aesthetic cross section thereof. The reinforcing panel fabricated in a factory is applied as to reduce labor costs and construction costs.

7 Claims, 10 Drawing Sheets

(51) Int. Cl.

| | |
|---|---|
| ***E04C 5/06*** | (2006.01) |
| ***E04C 5/07*** | (2006.01) |
| ***E04C 2/52*** | (2006.01) |
| *E04C 5/01* | (2006.01) |
| *E04C 5/18* | (2006.01) |

(52) U.S. Cl.
CPC ..... *E04G 23/0211* (2013.01); *E04G 23/0218* (2013.01); *E04C 5/01* (2013.01); *E04C 5/18* (2013.01)

(56) References Cited

U.S. PATENT DOCUMENTS 5,649,398 A * 7/1997 Isley, Jr. ..... E04C 5/07 24/304
5,678,374 A * 10/1997 Fukuoka ..... E01D 22/00 14/73
5,879,778 A * 3/1999 Barnes ..... E04G 23/0218 428/102
6,052,964 A * 4/2000 Ferm ..... E01C 7/147 404/64
6,183,835 B1 * 2/2001 Cho ..... B29C 70/083 428/113
6,312,541 B1 * 11/2001 Hemphill ..... E01C 7/147 156/293
6,389,775 B1 * 5/2002 Steiner ..... E04G 23/0218 52/600
7,207,149 B2 * 4/2007 Fyfe ..... E02D 27/42 156/73.2
RE39,839 E * 9/2007 Wheatley ..... 156/71
7,306,687 B2 12/2007 Fyfe
7,946,088 B1 * 5/2011 Fyfe ..... E04G 23/0218 52/309.13
8,479,468 B1 * 7/2013 Abbasi ..... E04G 23/0218 52/408
9,290,956 B1 * 3/2016 Wheatley ..... E04G 23/0229
9,790,697 B2 * 10/2017 Wheatley ..... E04G 23/0222
2004/0200173 A1 * 10/2004 Drake ..... E01C 7/147 52/514.5
2010/0107537 A1 * 5/2010 Hauser ..... E04G 23/0218 52/432
2011/0189456 A1 * 8/2011 Reck ..... C04B 28/02 428/220
2012/0110940 A1 * 5/2012 Hemphill ..... E04G 23/0218 52/514
2015/0167332 A1 * 6/2015 Shiota ..... E04G 23/0218 52/514
2016/0053492 A1 * 2/2016 Leinenbach ..... E04G 21/12 52/223.14

FOREIGN PATENT DOCUMENTS

| | | |
|---|---|---|
| JP | 2016094747 | 5/2016 |
| KR | 100454021 | 10/2004 |
| KR | 100469579 | 2/2005 |
| KR | 100697667 | 3/2007 |
| KR | 100771127 | 10/2007 |
| KR | 101103881 | 1/2012 |
| KR | 101169770 | 7/2012 |
| KR | 101612800 | 4/2016 |
| KR | 20170112956 | 10/2017 |

* cited by examiner

FIG. 4A
FIG. 4B
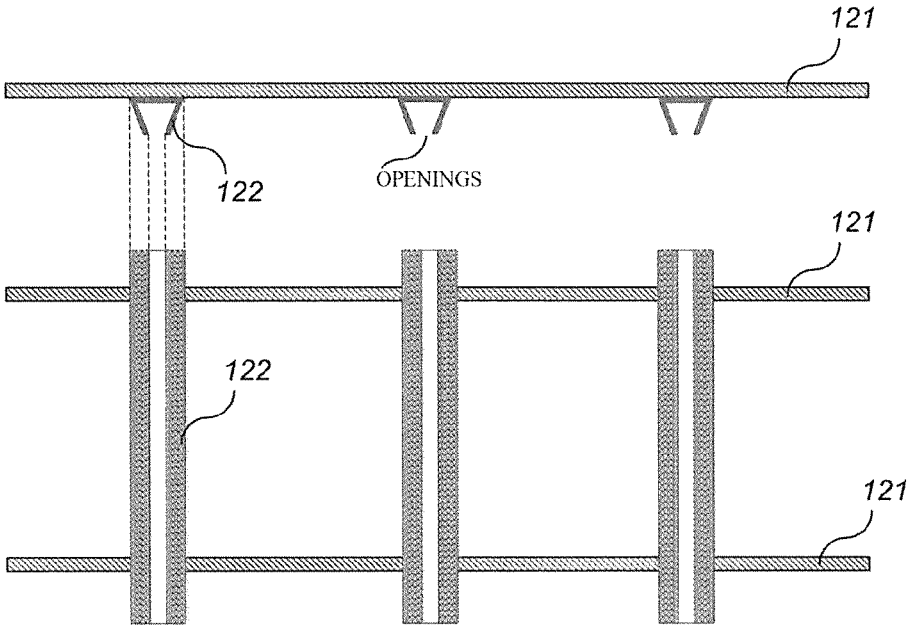
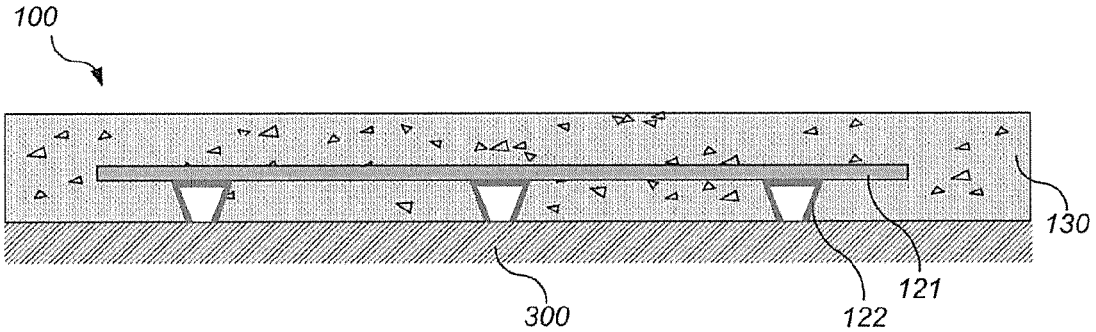
FIG. 5A
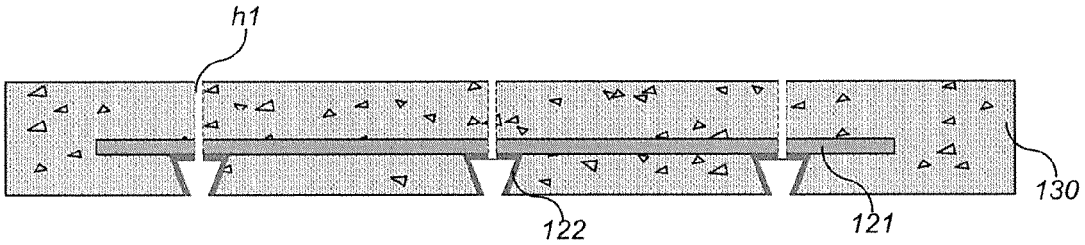
FIG. 5B

CONCRETE STRUCTURE USING REINFORCING PANEL INCLUDING EMBEDDED REINFORCING GRID AND METHOD OF REPAIRING AND REINFORCING THE SAME

CROSS-REFERENCE TO RELATED APPLICATION

This application claims priority to and the benefit of Korean Patent Application No. 2017-0155353, filed on Nov. 21, 2017, the disclosure of which is incorporated herein by reference in its entirety.

BACKGROUND

1. Field of the Invention

The present invention relates to repairing and reinforcing a concrete structure, and more particularly, to a concrete structure using a reinforcing panel including an embedded reinforcing grid which is pressed in and fixed to a cross section of the concrete structure to be repaired by precast-fabricating a reinforcing panel in which a reinforcing grid is embedded to repair or reinforce the concrete structure and a method of repairing and reinforcing the same.

2. Discussion of Related Art

Generally, a variety of concrete structures built for construction and civil engineering are deteriorated in concrete quality by effects of meteorological changes, a variety of contaminated water such as seawater, underground water, rainwater, and the like, and a compound. Accordingly, in the case of such concrete structures, safety inspection is periodically executed and it is necessary to repair or reinforce a concrete structure for increasing rigidity and load carrying capacity when strength of the concrete structure does not reach a necessary level or damages such as abnormal delamination, exfoliation, cracks, and the like are checked as a result of the safety inspection.

As such a technology related to repair and reinforcement of a concrete structure, there is disclosed a method of increasing a load carrying capacity of a concrete structure using stainless steel wire mesh assembled in a grid shape. In detail, the stainless steel wire mesh functions as rebar and acts like the concrete structure through attachment performance of reinforcing mortar which forms a finishing layer to provide a reinforcing effect.

In the case of the technology of repairing and reinforcing a concrete structure, the stainless steel wire mesh is used only in place of rebar and a coating thickness is formed using the reinforcing mortar. Accordingly, in a dimension of reinforcing due to the lack of strength in deteriorated concrete and overload thereon, the stainless steel wire mesh in place of rebar is attached to concrete using the reinforcing mortar and increases moment resistance of rebar against tensile force of a beam or a slab to provide a repair and reinforcement effect.

However, when a concrete structure is repaired and reinforced using the above-described wire mesh, since quality depends on a tension state of the wire mesh attached to the concrete structure and it is difficult to provide tensile force such that a repair and reinforcement effect is reduced.

As a prior art, Korean Patent Registration No. 10-469579 discloses the invention titled "A Panel Style Reinforcing Material for Concrete Structure and Repair and Reinforcement Method using thereof" which will be described with reference to FIG. 1.

FIG. 1 is a view of a panel type reinforcing material for a concrete structure according to the related art.

As shown in FIG. 1, a panel type reinforcing material 10 for a concrete structure according to the related art includes a plurality of spring rods 11 fabricated to have elasticity by continuously and repetitively bending stainless steel wire with increased tensile strength and fatigue strength through a shot peening treatment which applies a compression stress by colliding small iron balls injected at a high speed with a surface of material, and a plurality of compressed clips 12 which settle adjacent spring rods 11 arranged in multi-rows to be assembled in a panel shape having a lath structure.

In detail, the compressed clips 12 are settled in contact with the adjacent spring rods 11 when the spring rods 11 are arranged in the multi-rows, and the adjacent spring rods 11 are bent at right angles in a direction in which both ends thereof overlap with one another and are finished by settling the compressed clips 12. Here, reference numeral 42 refers to a fixing pin.

In the panel type reinforcing material for a concrete structure according to the related art, the stainless steel spring rods 11 shot peening treated are assembled in a panel shape such that secure tension of the panel type reinforcing material 10 and binding force thereof with a high-strength mortar filler may be increased using the strength and tensile force thereof and tightening of a turn buckle 30.

In the panel type reinforcing material for a concrete structure according to the related art, since both ends of the reinforcing material 10 are fixedly held by anchor bolts 41 and the reinforcing material 10 assembled in a panel shape using the immediately compressed clips 12 is connected, there is less fear of pulling out the reinforcing material 10 from concrete body, sliding, and a shear fracture thereof. Also, the reinforcing materials 10 are tightened by a turn buckle 30 to come into close contact with and be fixed to the concrete structure C such that construction may be more precisely performed and a thickness and an error in building a mortar finishing layer 20 may be reduced.

However, since the panel type reinforcing material for a concrete structure according to the related art includes the plurality of compressed clips 12 which settle the adjacent spring rods 11 to be assembled in the panel shape having the lath structure, a structure thereof is complicated and a construction time is increased.

Meanwhile, recently, when cracks occur in a concrete structure, an injection method using a resin such as epoxy and the like has been utilized. However, the resin is easily deteriorated when exposed to air and water. For example, when a surface of concrete is deteriorated by corrosion of rebar in the concrete and the like and a cross section is exfoliated, a concrete structure has been repaired or reinforced by adhering a carbon fiber compound material, a steel sheet, or the like to the surface using a resin or applying a cement-based repairing material such as mortar and the like.

However, the resin was easily deteriorated and lost adhesion thereof, and the cement-based mortar was easily detached. Also, when a cross section of damaged or deteriorated concrete was repaired using a bonding method or a cement-based material, there was fear of poor aesthetics thereof due to repair.

As the related art, Korean Patent Registration No. 10-1612800 discloses the invention titled "Structural Repair and Reinforcing Method for Concrete Structures such as Tunnel, Bridge Common Duct and Building by Using grid Fiber Mesh and Fiber Reinforced Cementitious Matrix for Increasing Load Capacity and Fire Resistance Performance," which will be described with reference to FIG. 2.

FIG. 2 is a view illustrating a state in which a ferroconcrete structure using a grid fiber mesh and a cement matrix as a reinforcing material is built using a repairing and reinforcing method according to the related art.

Referring to FIG. 2, the method of repairing and reinforcing a ferroconcrete structure using a grid fiber mesh and a cement matrix as reinforcing materials according to the related art includes (a) repair, reinforcement, and aseismatic design operation for a reinforcement design of a ferroconcrete structure C to be repaired, reinforced, and aseismatic-reinforced, (b) surface cleaning-up and wet surface forming operation for forming a preferable surface of the ferroconcrete structure C and maintaining a wet condition, (c) first cement matrix grouting operation of firstly applying a cement matrix 60, (d) grid fiber mesh fixing operation for fixing a grid fiber mesh 50, (e) second cement matrix grouting operation of completing construction by applying the cement matrix 60 to the surface of the ferroconcrete structure C to which the grid fiber mesh 50 is applied, and surface protectant coating operation of coating the cement matrix 60 with a surface protectant to protect the cement matrix 60.

In detail, the grid fiber mesh 50 includes a structure in which longitudinal fibers 51 longitudinally extended and lateral fibers 52 laterally extended intersect with each other to form a grid shape. The longitudinal fibers 51 and the lateral fibers 52 of the grid fiber mesh 50 may be formed of the same material or different materials. Particularly, the yarn count numbers and strand numbers of the longitudinal and lateral fibers 51 and 52 may differ. Here, reference numeral 71 refers to an anchor bolt, reference numeral 72 refers to an anchor plate, and reference numeral 73 refers to a nut. Also, reference numeral 80 refers to temporarily fixing means.

The method of repairing and reinforcing a ferroconcrete structure using a grid fiber mesh and a cement matrix as reinforcing materials according to the related art may improve repair and reinforcement through increasing attachment performance and strength development of the cement matrix 60, improve reinforcement and aseismatic reinforcement according to an increase in adhesive force of the grid fiber mesh 50 using the cement matrix 60 with improved adhesive force and fire resistance, and additionally increase fire resistance of the ferroconcrete structure C in case of fire.

However, in the case of method of repairing and reinforcing a ferroconcrete structure using a grid fiber mesh and a cement matrix according to the related art, as described above, the fiber mesh may be easily deteriorated and lose adhesion thereof and the cement-based mortar may be easily detached. Also, when a cross section of damaged or deteriorated concrete is repaired using a bonding method or a cement-based material, there is fear of poor aesthetics thereof due to repair.

SUMMARY OF THE INVENTION

It is an aspect of the present invention to provide a concrete structure using a reinforcing panel including an embedded reinforcing grid and a method of repairing and reinforcing the same, capable of repairing the concrete structure to have excellent resistance to an external environment and to be structurally excellent by applying a reinforcing panel having high durability, high strength, and high rigidity.

It is another aspect of the present invention to provide a concrete structure using a reinforcing panel including an embedded reinforcing grid and a method of repairing and reinforcing the same, capable of completely attaching the concrete structure and the reinforcing panel to each other as a whole by using a repairing material with high fluidity as a cement-based material injected into a repair cross section in comparison to existing bonding methods.

It is still another aspect of the present invention to provide a concrete structure using a reinforcing panel including an embedded reinforcing grid and a method of repairing and reinforcing the same, capable of preventing microcracks by completely injecting repairing cement mortar, which is a repairing material with high fluidity, into a part with microcracks at high pressure.

According to one aspect of the present invention, a concrete structure using a reinforcing panel including an embedded reinforcing grid includes a concrete structure in which a repair cross section is formed at a deteriorated or damaged part, a reinforcing grid in which reinforcing spacers and reinforcing channels, at certain intervals, are arranged in a grid shape and openings are formed at the reinforcing channels, a reinforcing panel precast-fabricated in a fabricating place to embed the reinforcing grid therein, a set anchor which includes an anchor bolt and an anchor nut and fixes the reinforcing panel to the repair cross section of the concrete structure, and repairing cement mortar injected between the repair cross section of the concrete structure and the reinforcing panel. Here, the repairing cement mortar is injected into the openings formed at the reinforcing channels to integrate the concrete structure with the reinforcing panel.

The reinforcing panel may include the reinforcing grid which includes the reinforcing spacers and the reinforcing channels and is formed by connecting the reinforcing spacers to the reinforcing channels, at certain intervals, in the grid shape through welding, and panel-forming mortar deposited above the reinforcing grid to embed the reinforcing grid. Here, the openings with an upper width smaller than a lower width may be formed at the reinforcing channels of the reinforcing grid, and the repairing cement mortar may be injected into the openings.

The reinforcing grid may be fabricated using a metal or compound material having high strength, high hardness, and high durability.

The reinforcing panel may be precast-fabricated to have embossing, intaglio, or color in a fabricating place.

The set anchor may include the anchor bolt with one side fastened to a drilled hole for the set anchor of the concrete structure and which passes through a through hole and is exposed outside when the reinforcing panel is pressed in, and the anchor nut fastened to the anchor bolt to additionally apply a pressure to the reinforcing panel. Here, the anchor bolt guides press fitting of the reinforcing panel into the repair cross section of the concrete structure.

An end of the anchor bolt, which is exposed outside after the reinforcing panel is pressed in the repair cross section of the concrete structure and fastened to the anchor nut, may be cut and removed.

A set anchor-embedding groove may be formed at an external cross section of the reinforcing panel, the end of the anchor bolt may be cut off, and then the set anchor-embedding groove may be finished with set anchor-embedding mortar.

The repairing cement mortar may be a flowable repairing material injected at high pressure between the repair cross section of the concrete structure and the reinforcing panel and may be injected into the openings of the reinforcing channels and microcracks present in the repair cross section.

According to another aspect of the present invention, a method of repairing and reinforcing a concrete structure using a reinforcing panel including an embedded reinforcing grid includes (a) checking a repair cross section of a concrete structure, which is deteriorated or damaged, (b) removing chippings of the repair cross section of the concrete structure and forming a drilled hole for a set anchor, (c) fastening an anchor bolt of the set anchor through the drilled hole and applying a primer to the repair cross section, (d) previously applying repairing cement mortar to a reinforcing panel or applying the repairing cement mortar to the repair cross section, (e) compressing the reinforcing panel, in which a reinforcing grid with reinforcing spacers and reinforcing channels arranged in a grid shape is embedded, to the repair cross section and injecting the repairing cement mortar into openings of the reinforcing channels of the reinforcing panel, (f) fixing the reinforcing panel to the repair cross section of the concrete structure by additionally applying a pressure using an anchor nut of the set anchor, and (g) completing repair and reinforcement of the concrete structure by cutting and removing an end of the anchor bolt of the set anchor when curing of the repairing cement mortar is completed. Here, the repairing cement mortar is injected into the openings formed at the reinforcing channels of the reinforcing panel such that the reinforcing panel and the concrete structure are integrated as a whole when the curing of the repairing cement mortar is completed.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIGS. 4A and 4B are an elevation view and a plan view illustrating the reinforcing grid of the reinforcing panel including the embedded reinforcing grid according to one embodiment of the present invention in detail;

FIGS. 5A and 5B are views illustrating a process of precast-fabricating the reinforcing panel including the embedded reinforcing grid according to one embodiment of the present invention;

DETAILED DESCRIPTION OF EXEMPLARY EMBODIMENTS

Figure 1:
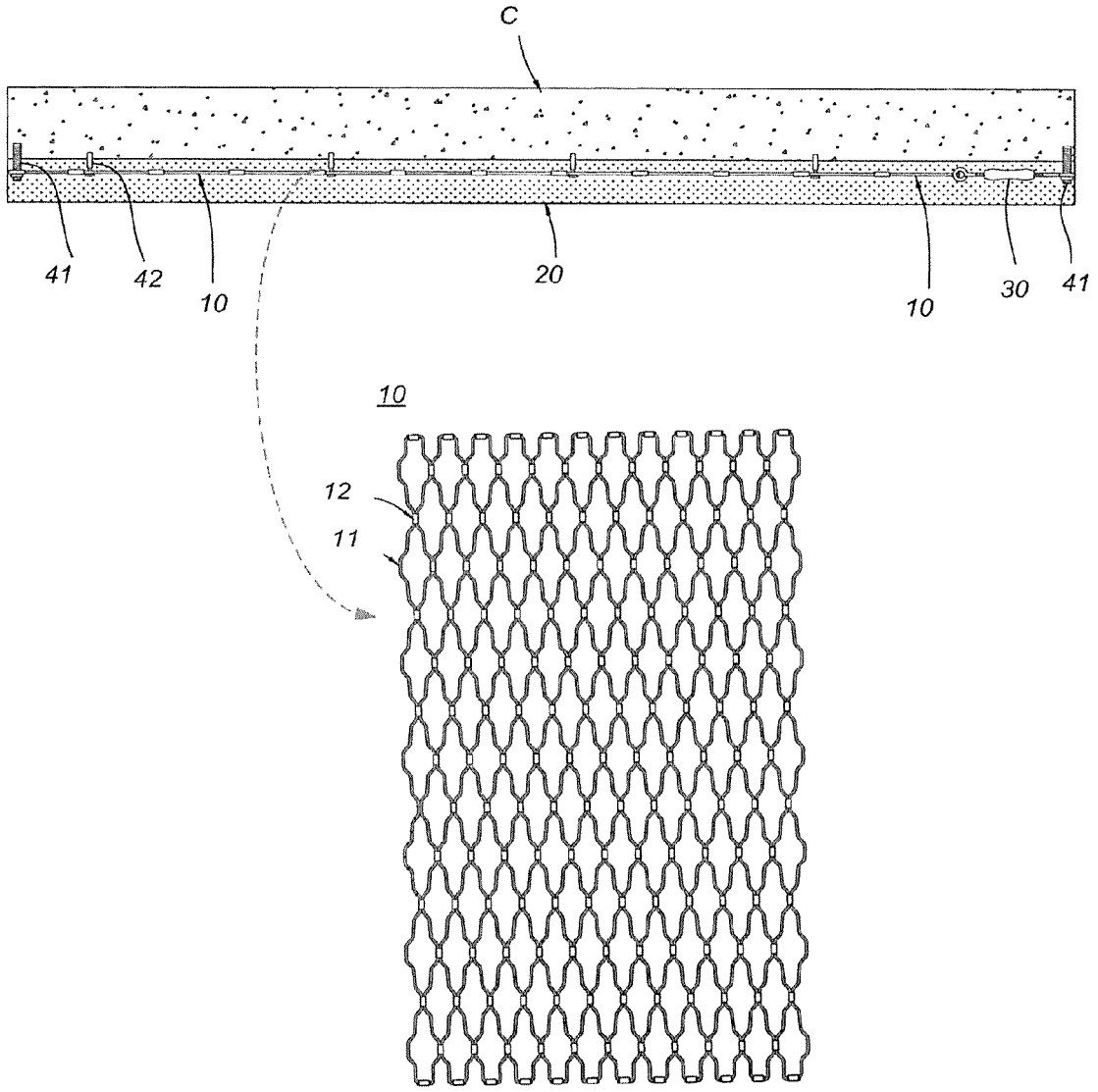
FIG. 1 is a view of a reinforcing panel for a concrete structure according to the related art.
Figure 2:
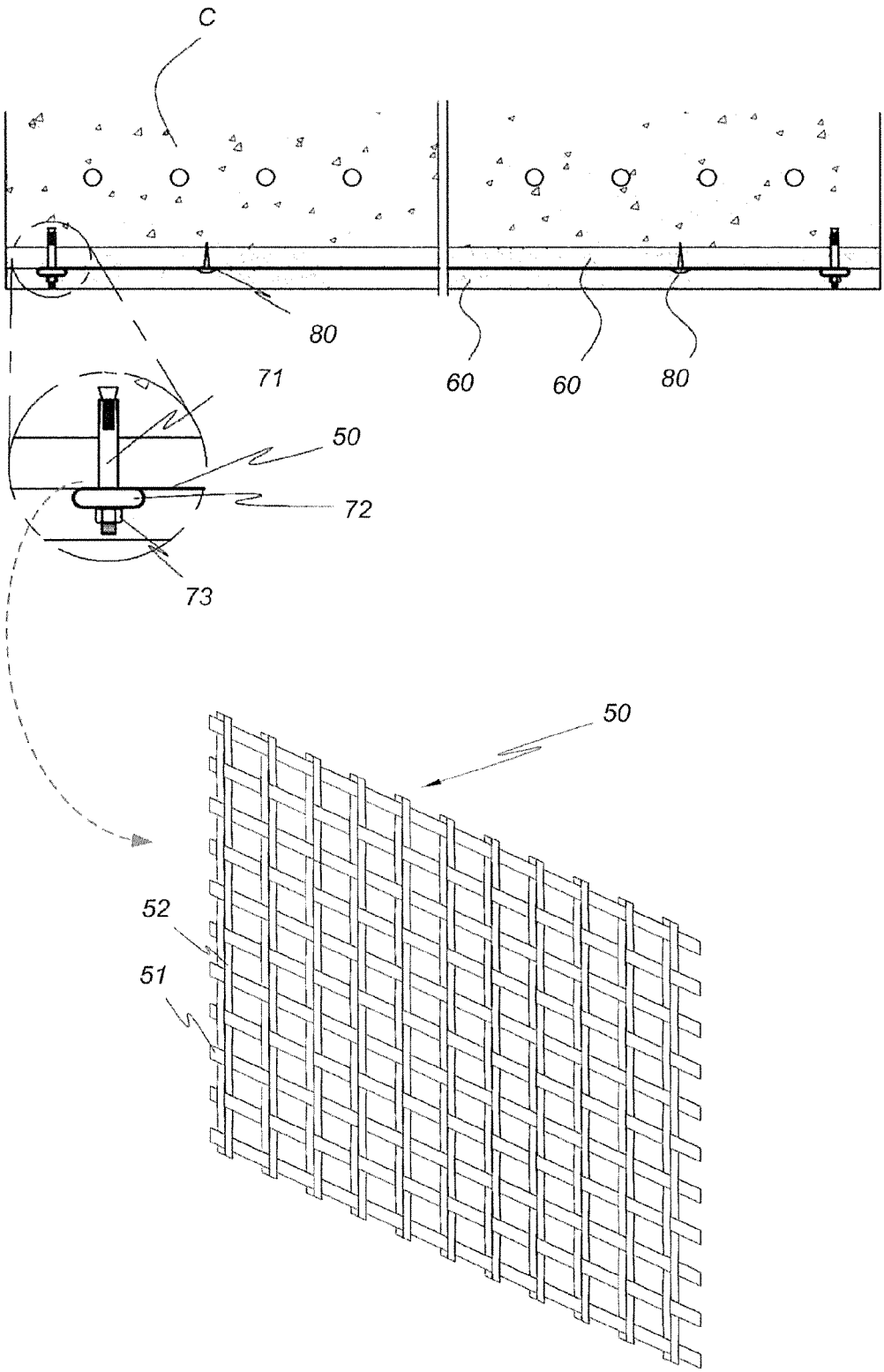
FIG. 2 is a view illustrating a state in which a ferroconcrete structure using a grid fiber mesh and a cement matrix as a reinforcing material is built using a repairing and reinforcing method according to the related art.

Hereinafter, embodiments of the present invention will be described in detail with reference to the attached drawings to allow one of ordinary skill in the art to easily execute the same. However, the present invention may be embodied in a variety of forms and is not limited to the embodiments described herein. Also, throughout the drawings, a part irrelevant to a description of the present invention will be omitted to clearly explain the present invention. Throughout the specification, like reference numerals refer to like portions.

Throughout the specification, when it is stated that a part "includes" an element, unless particularly defined otherwise, it means that the part does not exclude other elements and may further include other elements.

[Reinforcing Panel 100 Having Embedded Reinforcing Grid]

Figure 3A:
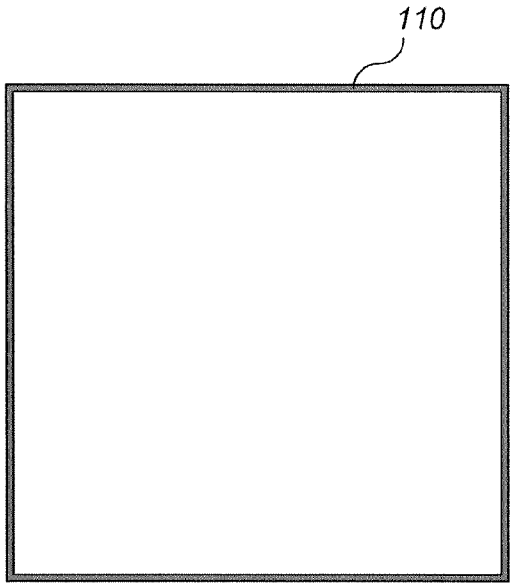
FIGS. 3A to 3D are views illustrating a reinforcing panel including an embedded reinforcing grid according to one embodiment of the present invention.
Figure 3B:
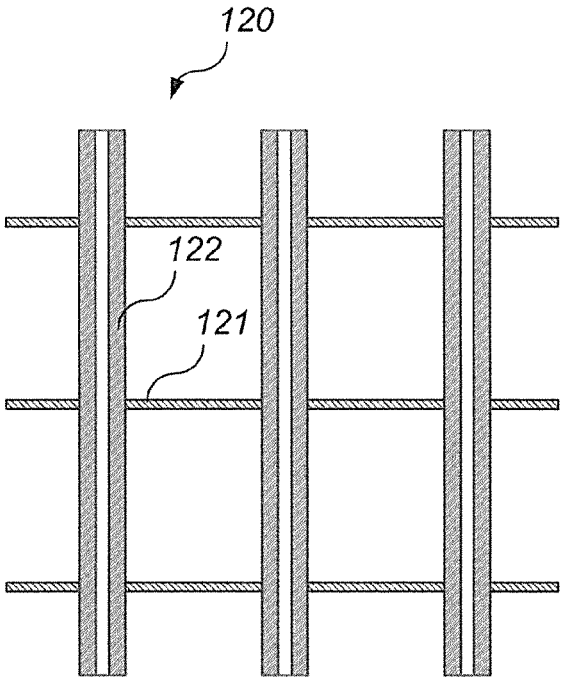
Figure 3C:
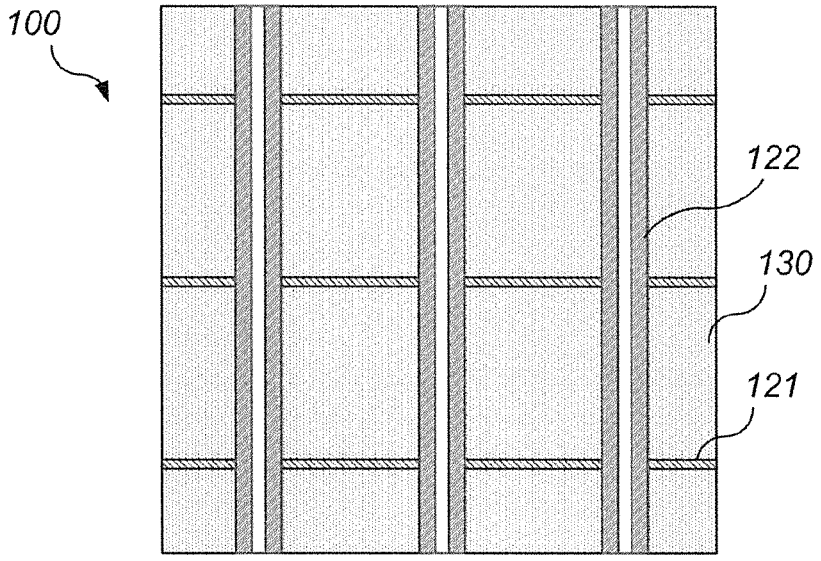
Figure 3D:
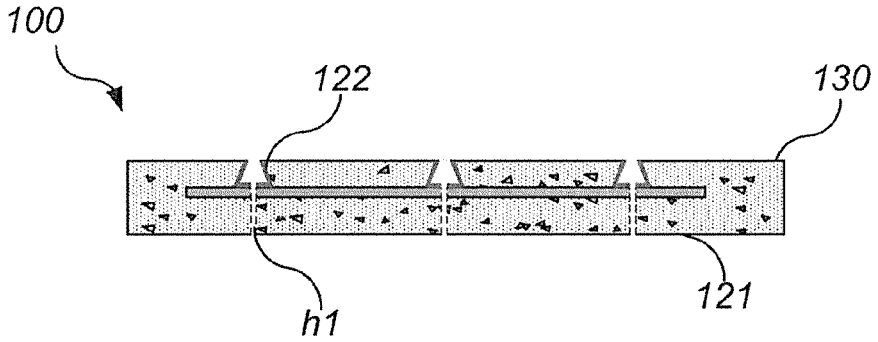

FIGS. 3A to 3D are views illustrating a reinforcing panel including an embedded reinforcing grid according to one embodiment of the present invention. FIGS. 4A and 4B are an elevation view and a plan view illustrating the reinforcing grid of the reinforcing panel including the embedded reinforcing grid according to one embodiment of the present invention in detail. FIG. 3A illustrates a mold, FIG. 3B illustrates a reinforcing grid, FIG. 3C is a plan view of a reinforcing panel, and FIG. 3D is a side view of the reinforcing panel.

As shown in FIGS. 3A to 3D, a reinforcing panel 100 including an embedded reinforcing grid according to one embodiment of the present invention includes a reinforcing grid 120 and panel-forming mortar 130 and is previously precast-fabricated in a fabricating place.

The reinforcing grid 120, as shown in FIG. 3B, includes reinforcing spacers 121 and reinforcing channels 122. Here, as shown in FIG. 3D, through holes h1 configured to pass through the reinforcing channels 122 and the panel-forming mortar 130 are funned.

Here, the reinforcing grid 120 may be installed above a mold 110 shown in FIG. 3A, and the reinforcing panel 100 is formed by depositing the panel-forming mortar 130 thereto.

In the reinforcing panel 100 including the embedded reinforcing grid according to one embodiment of the present invention, a concrete structure 200 and the reinforcing panel 100 may be integrated by forming openings, into which repairing mortar is injected, at the reinforcing channels 122 of the reinforcing grid 120. Also, as described below, the concrete structure may be easily repaired by injecting at high pressure or applying mortar, which is a flowable repairing material, between a repair cross section of the concrete structure 200 and the reinforcing panel 100.

In detail, as shown in FIGS. 4A and 4B, the reinforcing grid 120 includes the reinforcing spacers 121 and the reinforcing channels 122 and is formed by connecting the reinforcing spacers 121 and the reinforcing channels 122, at certain intervals, in a grid shape through welding. Here, as shown in FIG. 4A, the openings of the reinforcing channels 122 are formed to have an upper width smaller than a lower width, and the reinforcing channels 122 are fabricated to have high flexural strength due to high moment of inertia of area. Here, the reinforcing grid 120 may be fabricated using a metal or compound material having high strength, high hardness, and high durability.

Meanwhile, FIGS. 5A and 5B are views illustrating a process of precast-fabricating the reinforcing panel including the embedded reinforcing grid according to one embodiment of the present invention.

As shown in FIG. 5A, in the reinforcing panel 100 including the embedded reinforcing grid according to one embodiment of the present invention, the openings of the reinforcing channels 122 of the reinforcing grid 120 are placed to face a top surface 300 of a flat fabricating die and the panel-forming mortar 130 is deposited to provide a necessary thickness while the reinforcing spacers 121 are arranged to be positioned in a middle of a height of the reinforcing panel 100.

Also, as shown in FIG. 5B, the reinforcing panel 100 is completed by depositing the panel-forming mortar 130 to a cross section except the openings of the reinforcing channels 122. Here, the through holes h1 which pass through the reinforcing channels 122 and the panel-forming mortar 130 are formed such that set anchors may be fastened through the through holes h1 as described below.

Accordingly, the reinforcing panel 100 including the embedded reinforcing grid according to one embodiment of the present invention is attached to a surface of the concrete structure 200, which is deteriorated or damaged, to provide a repair or reinforcement effect. The reinforcing channels 122 having a channel shape and integrated with the concrete structure 200 through a frictional force and mechanical combination are formed on one side of the reinforcing grid 120 disposed in a grid shape when the reinforcing panel 100 is fabricated such that the concrete structure 200 may be easily repaired or reinforced by injecting at high pressure or applying repairing cement mortar 240 between the reinforcing panel 100 and the surface of the concrete structure 200 as described below.

[Concrete Structure 200 Using Reinforcing Panel 100 Including Embedded Reinforcing Grid]

Figure 6:
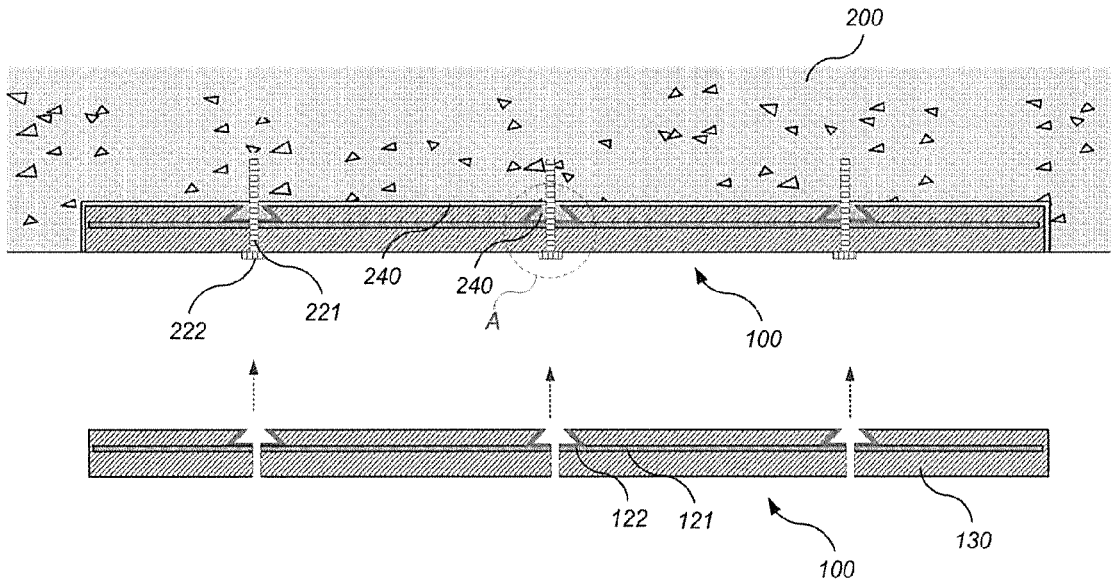
FIG. 6 is a cross-sectional view of a concrete structure using the reinforcing panel including the embedded reinforcing grid according to one embodiment of the present invention.

FIG. 6 is a cross-sectional view of the concrete structure using the reinforcing panel including the embedded reinforcing grid according to one embodiment of the present invention.

Referring to FIG. 6, the concrete structure 200 using the reinforcing panel including the embedded reinforcing grid according to one embodiment of the present invention includes the reinforcing panel 100, set anchors 220, and the repairing cement mortar 240. The reinforcing panel 100 includes the reinforcing grid 120 and the panel-forming mortar 130 and is precast-fabricated in a fabricating place. Here, the reinforcing grid 120 includes the reinforcing spacers 121 and the reinforcing channels 122 arranged in a grid shape, and each of the set anchors 220 includes an anchor bolt 221 and the anchor nut 222.

The concrete structure 200 has a repair cross section 210 formed at a deteriorated or damaged part by chippings and the like.

The reinforcing panel 100 is precast-fabricated in the fabricating place to arrange the reinforcing spacers 121 and the reinforcing channels 122 at certain intervals in the grid shape and to embed the reinforcing grid 120 with the concrete. Here, the reinforcing panel 100 includes the reinforcing grid 120 which includes the reinforcing spacers 121 and the reinforcing channels 122 and is formed by connecting the reinforcing spacers 121 to the reinforcing channels 122, at certain intervals, in the grid shape through welding and the panel-forming mortar 130 deposited above the reinforcing grid 120 to embed the reinforcing grid 120. Here, the openings with the upper width smaller than the lower width may be formed at the reinforcing channels 122 of the reinforcing grid 120, and the repairing cement mortar 240 may be injected into the openings. Here, the reinforcing grid 120 may be fabricated using a metal or compound material having high strength, high hardness, and high durability. Also, the reinforcing panel may be precast-fabricated to have embossing, intaglio, or color in the fabricating place.

The set anchor 220 includes the anchor bolt 221 and the anchor nut 222 and fixes the reinforcing panel 100 to the repair cross section 210 of the concrete structure 200. Here, the set anchor 220 includes the anchor bolt 221 with one side fastened to a drilled hole h2 for the set anchor 220 of the concrete structure 200 and which passes through the through hole h1 and is exposed outside when the reinforcing panel 100 is pressed in and the anchor nut 222 fastened to the anchor bolt 221 to additionally apply a pressure to the reinforcing panel 100. Here, the anchor bolt 221 may guide press fitting of the reinforcing panel 100 into the repair cross section 210 of the concrete structure 200. Here, the end of the anchor bolt 221, which is exposed outside after the reinforcing panel 100 is pressed in the repair cross section 210 of the concrete structure 200 and fastened to the anchor nut 222, may be cut and removed.

The repairing cement mortar 240 is injected between the repair cross section 210 of the concrete structure 200 and the reinforcing panel 100. Here, the repairing cement mortar 240 may be a flowable repairing material injected at high pressure between the repair cross section 210 of the concrete structure 200 and the reinforcing panel 100 and may be filled in the openings of the reinforcing channels 122 and microcracks present in the repair cross section 210.

Accordingly, the repairing cement mortar 240 is filled in the openings formed at the reinforcing channels 122 such that the concrete structure 200 and the reinforcing panel 100 may be integrated.

Figure 7:
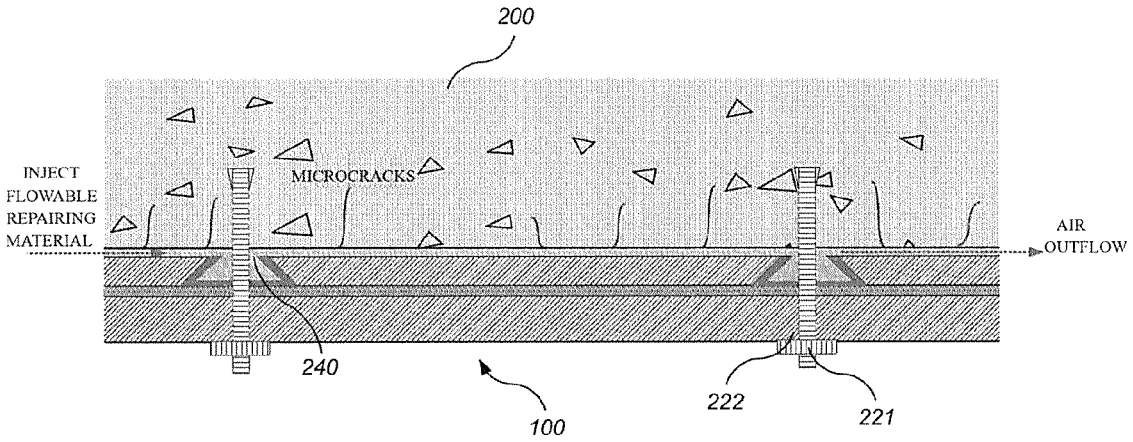
FIG. 7 is a view illustrating an injection of a flowable repairing material and air outflow when the concrete structure using the reinforcing panel including the embedded reinforcing grid according to one embodiment of the present invention is repaired.

Meanwhile, FIG. 7 is a view illustrating an injection of a flowable repairing material and air outflow when the concrete structure using the reinforcing panel including the embedded reinforcing grid according to one embodiment of the present invention is repaired.

As shown in FIG. 7, since microcracks are present in the repair cross section 210 of the concrete structure 200, which is deteriorated or damaged and needs to be repaired, when the repairing cement mortar 240 is filled by press fitting of the reinforcing panel 100, it is impossible to repair microcracks.

Accordingly, the reinforcing panel 100 including the embedded reinforcing grid according to one embodiment of the present invention is disposed at a certain interval from the repair cross section 210 of the concrete structure 200 to be repaired, and is fixed using the set anchors 220. Here, to increase a construction speed by reducing the number of necessary set anchors 220 and to more strongly fix the reinforcing panel 100, a supporting member, for example, lumber and the like may support between the set anchors 220 and the reinforcing panel 100 and then set anchors 200 may be fastened.

Also, after the reinforcing panel 100 is disposed on and fixed to the repair cross section 210 of the concrete structure 200, a plurality of inlets and a plurality of air outlets are formed on one side and the other side of the repair cross section 210, respectively, and the interval between the reinforcing panel 100 and the repair cross section 210 except them is blocked using putty and the like and then the repairing cement mortar 240, which is a repairing material with high fluidity, is injected thereinto at high pressure.

Here, since the repairing material with high fluidity is injected at high pressure, not only the openings of the reinforcing channels 122 of the reinforcing panel 100 but also microcracks present in the repair cross section 210 may be completely filled with the repairing cement mortar 240 which is the repairing material with high fluidity.

Afterward, when the repairing cement mortar 240 is cured, the end of the anchor bolt 221 of the set anchor 220 for fixing is cut and the repair cross section 210 is finished with surface treatment such that the repair and reinforcement of the concrete structure 200 may be completed.

Eventually, according the embodiments of the present invention, a reinforcing panel having high durability, high strength, and high hardness is applied such that a concrete structure may be repaired to have excellent resistance to an external environment and to be structurally excellent. Also, in comparison to existing bonding methods, a concrete structure and a reinforcing panel may be completely attached to each other as a whole using a repairing material with high fluidity as a cement-based material injected into a repair cross section.

Also, according to the embodiments of the present invention, a part with microcracks is completely filled with repairing cement mortar, which is a repairing material with highly fluidity, injected at high pressure such that microcracks may be prevented.

[Method of Repairing and Reinforcing Concrete Structure Using Reinforcing Panel Including Embedded Reinforcing Grid]

Figure 8:
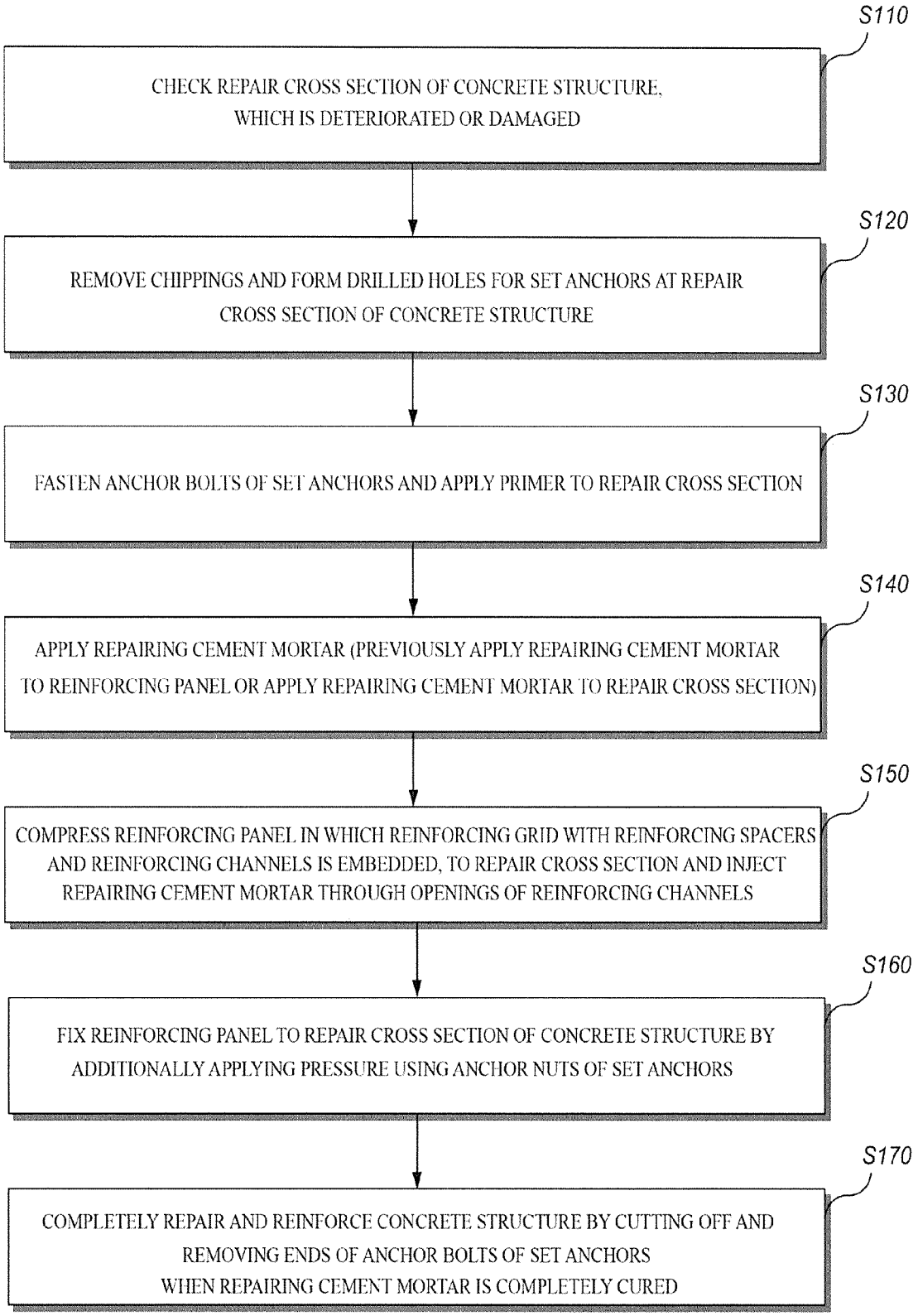
FIG. 8 is a flowchart illustrating of a method of repairing and reinforcing a concrete structure using a reinforcing panel including an embedded reinforcing grid according to one embodiment of the present invention.

FIG. 8 is a flowchart illustrating of a method of repairing and reinforcing a concrete structure using a reinforcing panel including an embedded reinforcing grid according to one embodiment of the present invention, and FIGS. 9A to 9G are views illustrating the method of repairing and reinforcing the concrete structure using the reinforcing panel including the embedded reinforcing grid, shown in FIG. 8 in detail.

Referring to FIGS. 8 and 9, in the method of repairing and reinforcing a concrete structure using a reinforcing panel including an embedded reinforcing grid according to one embodiment of the present invention, as a method of repairing and reinforcing a concrete structure using a reinforcing panel, first, the concrete structure 200 which has a deteriorated or damaged part, for example, the repair cross section 210 of a bottom surface of a decrepit slab is checked (110). In detail, as shown in FIG. 9A, a size of the repair cross section 210 is determined depending on whether the concrete structure 200 is deteriorated or damaged, and the reinforcing panel 100 may be precast-fabricated corresponding to the determined size of the repair cross section 210 in a factory. Here, the repair cross section 210 may be determined to be a rectangular or square shape and a depth of the repair cross section 210 may be determined in consideration of the deteriorated or damaged part, for example, a neutralization depth and the like.

Figure 9A:
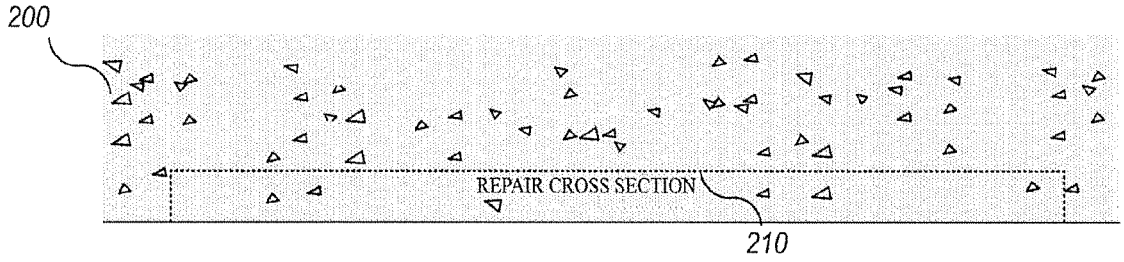
FIGS. 9A to 9G are views illustrating the method of repairing and reinforcing the concrete structure using the reinforcing panel including the embedded reinforcing grid, shown in FIG. 8 in detail.
Figure 9B:
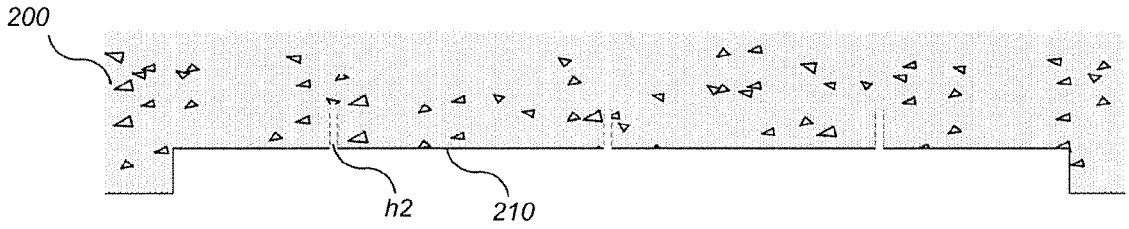

Next, as shown in FIG. 9B, for example, chippings and the like are removed from the repair cross section 210 of the concrete structure 200 and the drilled holes h2 for the set anchors 220 are formed.

Figure 9C:
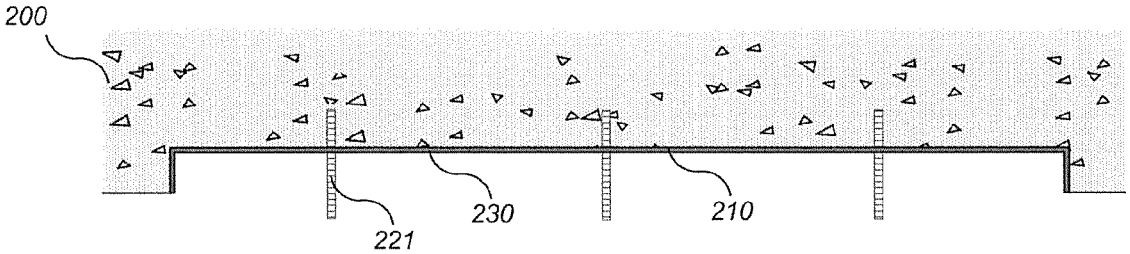

Next, as shown in FIG. 9C, the anchor bolts 221 of the set anchors 220 are fastened through the drilled holes h2 and a primer 230 for adhesion is applied (130). In detail, the set anchors 220 include the anchor bolts 221 and the anchor nuts 222, and the anchor bolts 221 are arranged at preset intervals. Also, a length of the anchor bolts 221 may be formed to be exposed outside in consideration of a height of the reinforcing panel 100.

Figure 9D:
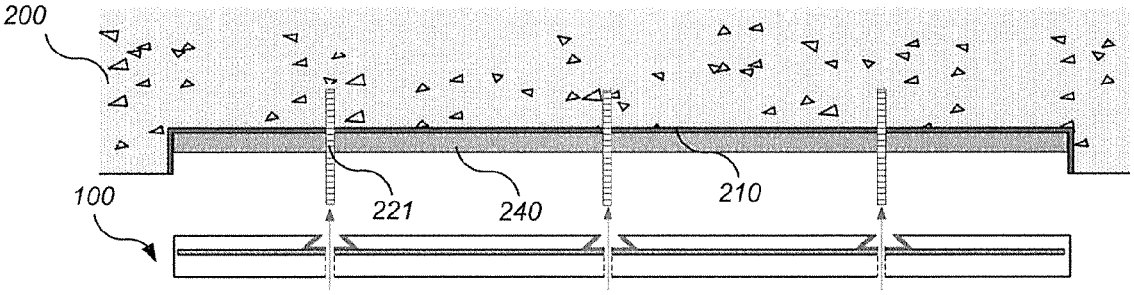

Next, as shown in FIG. 9D, the repairing cement mortar 240 is previously applied to the reinforcing panel 100 or is applied to the repair cross section 210 (140). Here, it may be checked whether the reinforcing panel 100 precast-fabricated is insertable into the repair cross section 210 according to guide of the anchor bolts 221. Also, the reinforcing grid 120 of the reinforcing panel 100 includes the reinforcing spacers 121 and the reinforcing channels 122 and the through holes h1 are formed in central parts of the reinforcing channels 122 such that the reinforcing panel 100 may be inserted according to the guide of the anchor bolts 221 inserted through the through holes h1.

Figure 9E:
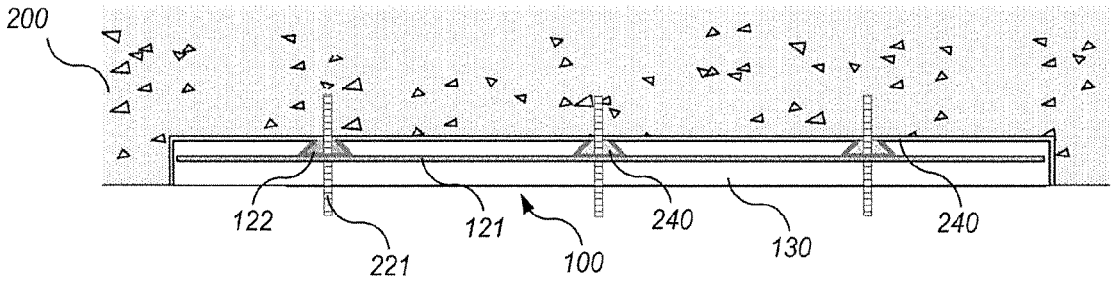

Next, as shown in FIG. 9E, the reinforcing panel 100 in which the reinforcing grid 120 with the reinforcing spacers 121 and the reinforcing channels 122 arranged in the grid shape is embedded is compressed to the repair cross section 210, and the repairing cement mortar 240 is filled in the openings of the reinforcing channels 122 of the reinforcing panel 100 (150). Here, the repairing cement mortar 240 is a repairing material with high fluidity and may have a slump flow of, for example, 600 mm or more.

Figure 9F:
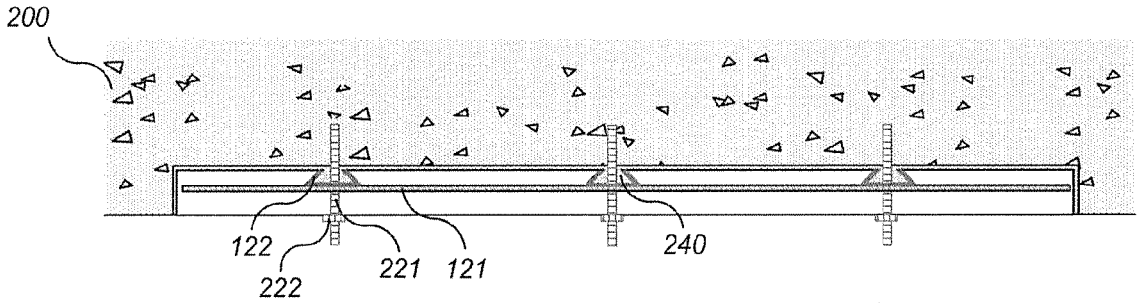

Next, as shown in FIG. 9F, the reinforcing panel 100 is fixed to the repair cross section 210 of the concrete structure 200 by additionally applying a pressure using the anchor nuts 222 of the set anchors 220 (160).

Figure 9G:
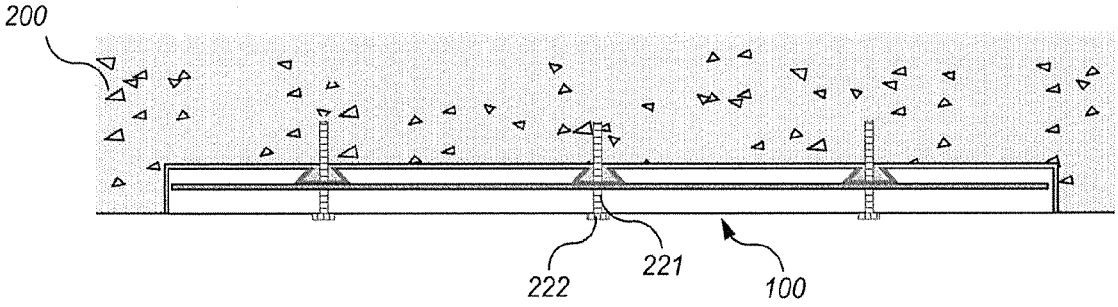

Next, when the repairing cement mortar 240 is adequately cured, the ends of the anchor bolts 221 of the set anchors 220 are cut off and removed such that the repair and reinforcement of the concrete structure 200 is completed (170). In detail, as shown in FIG. 9G, the repairing cement mortar 240 is filled in the openings formed at the reinforcing channels 122 of the reinforcing panel 100 such that the reinforcing panel 100 and the concrete structure 200 may be integrated as a whole when the repairing cement mortar 240 is completely cured.

Figure 10A:
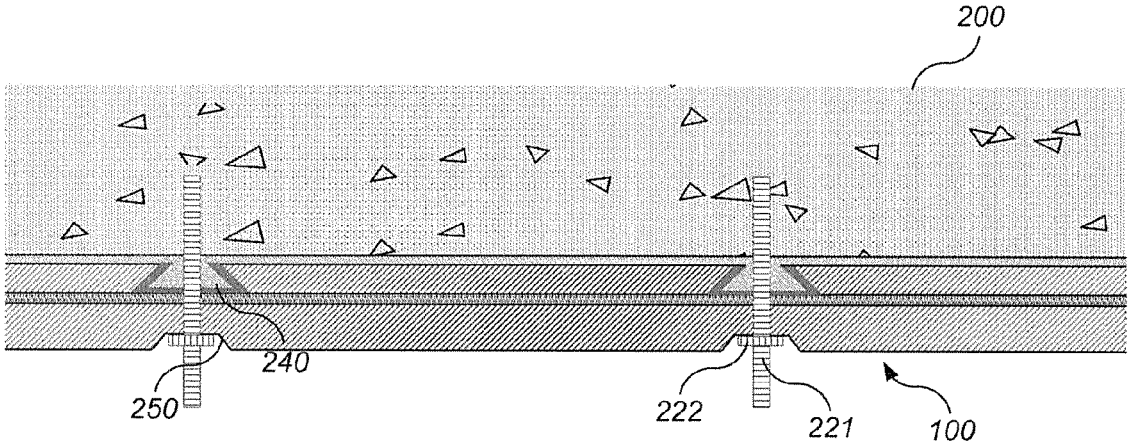
FIGS. 10A to 10C are views illustrating an example of embedding set anchors in the reinforcing panel when the concrete structure using the reinforcing panel including the embedded reinforcing grid is repaired.
Figure 10B:
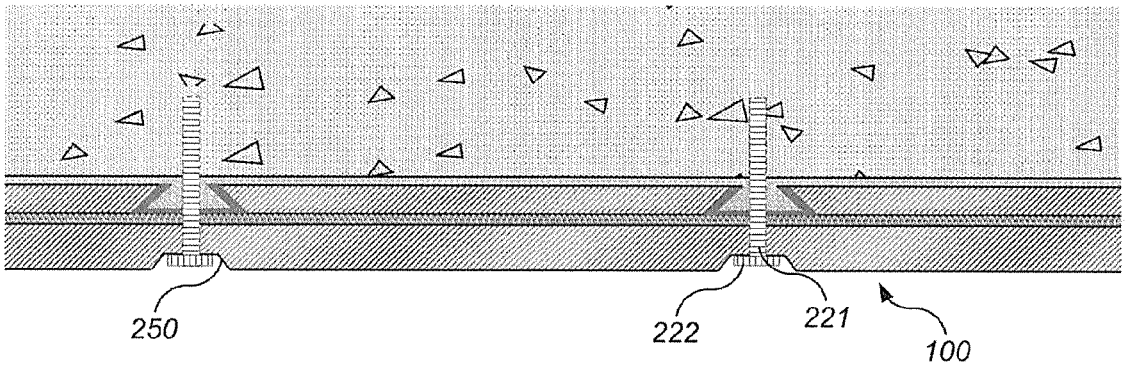
Figure 10C:
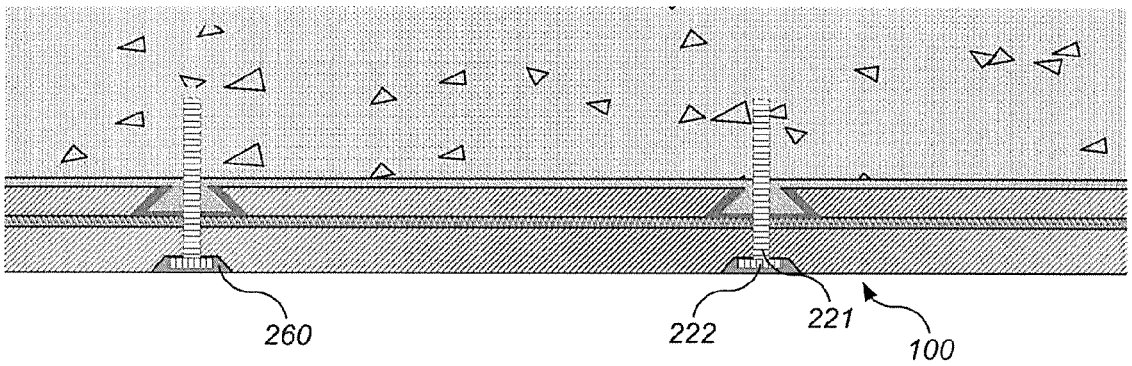

Meanwhile, FIGS. 10A to 10C are views illustrating an example of embedding the set anchors in the reinforcing panel when the concrete structure using the reinforcing panel including the embedded reinforcing grid is repaired.

As shown in FIG. 10A, it is shown that set anchor-embedding grooves 250 are formed at and fixed to a cross section of the reinforcing panel 100, at which the anchor bolts 221 and the anchor nuts 222 of the set anchors 220 are installed, in consideration of aesthetics of the repair cross section 210 after repair of the concrete structure 200. FIG. 10B illustrates that the ends of the anchor bolts 221 are cut off FIG. 10C illustrates that the set anchor-embedding grooves 250 are finished with set anchor embedding mortar 260.

Also, according to the embodiments of the present invention, since the reinforcing panel 100 is precast-fabricated in the factory, embossing, intaglio, color, and the like may be easily added to an external surface of the reinforcing panel 100 and an excellent exterior may be provided after repair due to an aesthetic cross section thereof. Also, the reinforcing panel 100 previously fabricated in the factory is applied such that labor costs may be reduced and accordingly construction costs may be reduced.

According to the embodiments of the present invention, a reinforcing panel having high durability, high strength, and high hardness is applied such that a concrete structure may be repaired to have excellent resistance to an external environment and to be structurally excellent.

According to the embodiments of the present invention, in comparison to existing bonding methods, a concrete structure and a reinforcing panel may be completely attached to each other as a whole using a repairing material with high fluidity as a cement-based material injected into a repair cross section.

According to the embodiments of the present invention, a part with microcracks is completely filled with repairing cement mortar, which is a repairing material with highly fluidity, injected at high pressure such that microcracks may be prevented.

According to the embodiments of the present invention, since a reinforcing panel is precast-fabricated in a factory, embossing, intaglio, color, and the like may be easily added to an external surface of the reinforcing panel and an excellent exterior may be provided after repair due to an aesthetic cross section thereof.

According to the embodiments of the present invention, a reinforcing panel previously fabricated in a factory is applied such that labor costs may be reduced and accordingly construction costs may be reduced.

The above description of the present invention is for example, and it will be understood that other detailed modification may be easily made by one of ordinary skill in the art without changing of the technical concept or essential features of the present invention. Therefore, the above-described embodiments should be understood to be exemplary and not to be limitative in every aspect. For example, elements described as a single form may be executed while being distributed, and similarly, elements described as being distributed may be executed as being combined.

The scope of the present disclosure will be defined by the following claims rather than the above detailed description, and all changes and modifications derived from the meaning and the scope of the claims and equivalents thereof should be understood as being included in the scope of the present invention.

What is claimed is:

1. A method of repairing and reinforcing a concrete structure using a reinforcing panel, comprising:

(a) checking a repair cross section of a concrete structure, which is deteriorated or damaged;

(b) removing chippings of the repair cross section of the concrete structure and forming a drilled hole for a set anchor;

(c) fastening an anchor bolt of the set anchor through the drilled hole and applying a primer to the repair cross section;

(d) previously applying repairing cement mortar to a reinforcing panel or applying the repairing cement mortar to the repair cross section;

(e) compressing the reinforcing panel, in which a reinforcing grid with reinforcing spacers and reinforcing channels arranged in a grid shape is embedded, to the repair cross section and injecting the repairing cement mortar into openings of the reinforcing channels of the reinforcing panel, wherein the reinforcing channels and the reinforcing spacers are separately formed, and the reinforcing channels are respectively disposed above the reinforcing spacers in a thickness direction of the reinforcing panel;

(f) fixing the reinforcing panel to the repair cross section of the concrete structure by additionally applying a pressure using an anchor nut of the set anchor; and (g) completing repair and reinforcement of the concrete structure by cutting and removing an end of the anchor bolt of the set anchor when curing of the repairing cement mortar is completed, wherein the repairing cement mortar is injected into the openings formed at the reinforcing channels of the reinforcing panel such that the reinforcing panel and the concrete structure are integrated as a whole when the repairing cement mortar is completely cured, and wherein the openings of the reinforcing channels of the reinforcing grid are located on a side of the reinforcing panel, the side of the reinforcing panel faces the repair cross section, and a shape of each of the openings has a width decreasing in a direction toward the repair cross section.

2. The method of claim 1, wherein the reinforcing panel comprises:

the reinforcing grid comprises the reinforcing spacers and the reinforcing channels, and the reinforcing grid is formed by connecting the reinforcing spacers to the reinforcing channels at intervals and in the grid shape through welding; and a panel-forming mortar deposited on the reinforcing grid to embed the reinforcing grid, and the repairing cement mortar is injected into the openings.

3. The method of claim 1, wherein the reinforcing panel is precast-fabricated to have embossing, intaglio, or color in a fabricating place.

4. The method of claim 1, wherein one side of the anchor bolt is fastened to the drilled hole for the set anchor of the concrete structure and the anchor bolt passes through a through hole and is exposed outside when the reinforcing panel is pressed in; and the anchor nut is fastened to the anchor bolt to additionally apply the pressure to the reinforcing panel, wherein the anchor bolt guides the reinforcing panel to fit into the repair cross section of the concrete structure while the reinforcing panel is pressed to the repair cross section.

5. The method of claim 4, wherein an end of the anchor bolt exposed outside after the reinforcing panel is pressed in the repair cross section of the concrete structure and fastened to the anchor nut is cut and removed.

6. The method of claim 4, further comprising:

forming a set anchor-embedding groove on an external surface of the reinforcing panel;

and finishing the set anchor-embedding groove with set anchor-embedding mortar.

7. The method of claim 1, wherein the repairing cement mortar is a flowable repairing material injected at high pressure between the repair cross section of the concrete structure and the reinforcing panel and is filled in the openings of the reinforcing channels and microcracks present in the repair cross section.

* * * * *